US009263807B2

(12) United States Patent
Gunnels

(10) Patent No.: US 9,263,807 B2
(45) Date of Patent: Feb. 16, 2016

(54) WAVEGUIDE OR SLOT RADIATOR FOR WIDE E-PLANE RADIATION PATTERN BEAMWIDTH WITH ADDITIONAL STRUCTURES FOR DUAL POLARIZED OPERATION AND BEAMWIDTH CONTROL

(71) Applicant: PC-TEL, Inc., Bloomingdale, IL (US)

(72) Inventor: Robert Gunnels, Homer Glen, IL (US)

(73) Assignee: PC-TEL, Inc., Bloomingdale, IL (US)

( * ) Notice: Subject to any disclaimer, the term of this patent is extended or adjusted under 35 U.S.C. 154(b) by 0 days.

(21) Appl. No.: 13/964,407

(22) Filed: Aug. 12, 2013

(65) Prior Publication Data

US 2013/0328733 A1 Dec. 12, 2013

Related U.S. Application Data

(62) Division of application No. 13/250,561, filed on Sep. 30, 2011.

(60) Provisional application No. 61/388,945, filed on Oct. 1, 2010.

(51) Int. Cl.

| | |
|---|---|
| ***H01Q 21/00*** | (2006.01) |
| ***H01Q 21/29*** | (2006.01) |
| ***H01Q 9/16*** | (2006.01) |
| ***H01Q 13/18*** | (2006.01) |
| ***H01Q 21/24*** | (2006.01) |

(52) U.S. Cl.

CPC ..... *H01Q 21/29* (2013.01); *H01Q 9/16* (2013.01); *H01Q 13/18* (2013.01); *H01Q 21/24* (2013.01)

(58) Field of Classification Search

USPC ..... 343/725, 702, 727, 768

See application file for complete search history.

(56) References Cited

U.S. PATENT DOCUMENTS

| | | | | |
|---|---|---|---|---|
| 3,623,112 | A * | 11/1971 | Rupp | H01Q 3/26 333/238 |
| 4,183,027 | A * | 1/1980 | Ehrenspeck | H01Q 7/00 343/726 |
| 4,710,775 | A * | 12/1987 | Coe | H01Q 13/18 343/727 |
| 7,868,842 | B2 | 1/2011 | Chair | |

OTHER PUBLICATIONS

Rangsan Wongsan, A Wide-Beam Array Antenna Using Shorted-End Curved Dipoles on a Reflector Plane, ISSN: 1109-2742; Issue 2, vol. 8, Feb. 2009, pp. 207-216.

Kuga Nobuhiro and Arai Hiroyuki, A Horizontal Polarized Wide-Beam Antenna with Holed Rectangular Patch and Monopole Elements, Science Links Japan, ISSN: 0913-5685, http://sciencelinks.jp/j-east/article/200102/000020010200A1036048.php, 2000.

Horizontally Polarized Sector Antennas, SAH58-WB, Laird Technologies, Nov. 22, 2013.

* cited by examiner

*Primary Examiner* — Hoang V Nguyen
*Assistant Examiner* — Hai Tran
(74) *Attorney, Agent, or Firm* — Husch Blackwell LLP

(57) ABSTRACT

An apparatus and method are provided for producing a wide E-plane half power beamwidth. The apparatus can include a dipole antenna and a complimentary slot antenna in an infinite ground plane. The apparatus can also include a waveguide with surrounding structure that can be adjusted to produce the desired half power beamwidth.

17 Claims, 14 Drawing Sheets

STRIP DIPOLE

SLOT IN INFINITE GROUND PLANE

WAVEGUIDE OR SLOT RADIATOR FOR WIDE E-PLANE RADIATION PATTERN BEAMWIDTH WITH ADDITIONAL STRUCTURES FOR DUAL POLARIZED OPERATION AND BEAMWIDTH CONTROL

CROSS-REFERENCE TO RELATED APPLICATIONS

This application is a divisional of, claims priority to, and hereby incorporates by reference U.S. patent application Ser. No. 13/250,561 filed Sep. 30, 2011 and titled "Waveguide or Slot Radiator for Wide E-Plane Radiation Pattern Beamwidth With Additional Structures for Dual Polarized Operation and Beamwidth Control", which claims priority to U.S. Provisional Patent Application No. 61/388,945 filed Oct. 1, 2010 and titled "High Isolation Antenna With Adjustable Half Power Beamwidth". U.S. Application No. 61/388,945 is hereby incorporated by reference.

FIELD OF THE INVENTION

The present invention relates generally to antennas. More particularly, the present invention relates to a waveguide and slot radiator for achieving a wide E-plane radiation pattern beamwidth.

BACKGROUND

Communication systems known in the art use polarization diversity to improve system performance. For example, dual polarized base station antennas often include two ports that individually radiate or receive signals of orthogonal polarizations. These antennas typically are directional in azimuth and are used for sectoral coverage. Therefore, it is desirable for the two antenna ports to have equal azimuth beamwidths.

Known cellular base station installations are designed to provide 360 degree coverage divided into three 120 degree wide sectors. Dual polarized sector coverage base station antennas with both vertical and horizontal polarizations and nearly equal azimuth beamwidths of about 120 degrees are desirable. However, such antennas have been difficult to design. This is because a simple dipole can be appropriately placed over a small ground plane to achieve a 120 degree beamwidth in the H-plane, but not in the E-plane.

To overcome the known design difficulties of producing vertical and horizontal polarized radiation patterns with azimuth beamwidths of about 120 degrees, known antennas have employed dual slant polarizations (+/−45 degrees). Characteristics related to geometric symmetry in the antenna structure provide comparable beamwidths for each polarization.

However, the use of dual slant polarizations has been insufficient for several reasons. First, on mechanical boresight of a dual slant polarized antenna, the two polarizations are predominantly orthogonal. However, at angles off boresight, the polarizations become progressively less orthogonal until at 90 degrees azimuth, the polarizations are predominantly vertical. This characteristic results in a reduction of polarization diversity gain.

Furthermore, dual 45 degree slant antennas typically exhibit poor port-to-port isolation performance because the array elements of one polarization are not orthogonal to all elements of the other polarizations. This results in significant coupling between various elements of the two polarizations, thus degrading isolation.

In view of the above, there is a continuing, ongoing need for a structure that can provide a 120 degree E-plane half power beamwidth. Preferably, such a structure can be easily adjusted for other beamwidths and provide high isolation between polarizations.

SUMMARY

According to one embodiment of the present invention an apparatus that includes a dipole antenna and a slot antenna is provided. The slot antenna can be complimentary to the dipole antenna, the slot antenna can be disposed in a ground plane, and dimensions of the dipole antenna can be substantially equal to dimensions of the slot antenna. Radiation emitted from the slot antenna can include a wide E-plane half power beamwidth.

The dipole antenna can emit a radiation pattern, the slot antenna can emit a radiation pattern, and, in some embodiments, the first and second radiation patterns are substantially equal. A polarization of the dipole antenna can be orthogonal to a polarization of the slot antenna.

According to another embodiment of the present invention, an apparatus that includes a waveguide, a back plane, and a plurality of adjustable plates is provided. The waveguide can be defined by a plurality of waveguide walls, and the back plane can be connected to one end of each of the plurality of waveguide walls to short the waveguide. The plurality of adjustable plates can be connected to open ends of at least some of the plurality of waveguide walls at an angle $\theta$, and radiation emitted from the waveguide can include a wide E-plane half power beamwidth.

In some embodiments, the waveguide can be rectangular, and at least some of the back plane and the plurality of waveguide walls can be metal.

The plurality of waveguide walls can define an internal dimension $\alpha$, and an E-plane probe can be affixed to a printed circuit board, or otherwise mechanically supported, within the waveguide to excite a fundamental mode of the waveguide. The internal dimension $\alpha$ can be chosen to allow the radiation to propagate.

In some embodiments, a first of the plurality of waveguide walls can define a first side of the waveguide, a second of the plurality of waveguide walls can define a second side of the waveguide, a third of the plurality of waveguide walls can define a third side of the waveguide, and a fourth of the plurality of waveguide walls can define a fourth side of the waveguide. Further, a first of the plurality of adjustable plates can be connected to an open end of the fourth of the plurality of waveguide walls, and a second of the plurality of adjustable plates can be connected to an open end of the second of the plurality of waveguide walls.

The angle $\theta$ can be defined as an angle between the second of the plurality of adjustable plates and the first of the plurality of waveguide walls, and each of the plurality of adjustable plates can include a length L. According to embodiments of the present invention, the length L and the angle $\theta$ are capable of being adjusted to produce a desired impedance and the wide E-plane half power beamwidth. For example, when the angle $\theta$ is approximately 35 degrees, the length L can be adjusted from 0 to approximately 1.3 inches to achieve the E-plane half power beamwidth of approximately 60 degrees to approximately 165 degrees.

In some embodiments, a dipole can be disposed over an approximate center of the waveguide, and a radiation emitted from the dipole can be orthogonal in polarization to the radiation emitted from the waveguide.

A balanced microstrip can feed the dipole, and the balanced microstrip can include a balun and an impedance transformer deposited on printed circuit board. If the waveguide is disposed on a first side of the back plane, then the printed circuit board can be disposed on a second side of the back plane.

According to still further embodiments of the present invention, a method is provided. The method can include defining a waveguide with a plurality of waveguide walls, shorting the waveguide with a back plane connected to one end of each of the plurality of waveguide walls, providing a plurality of adjustable plates connected to open ends of at least some of the plurality of waveguide walls at an angle θ, each of the plurality of adjustable plates including a length L, and adjusting the length L and the angle θ to produce a desired impedance and an E-plane half power beamwidth of radiation emitted from the waveguide.

DESCRIPTION OF THE PREFERRED EMBODIMENTS

Figure 1:
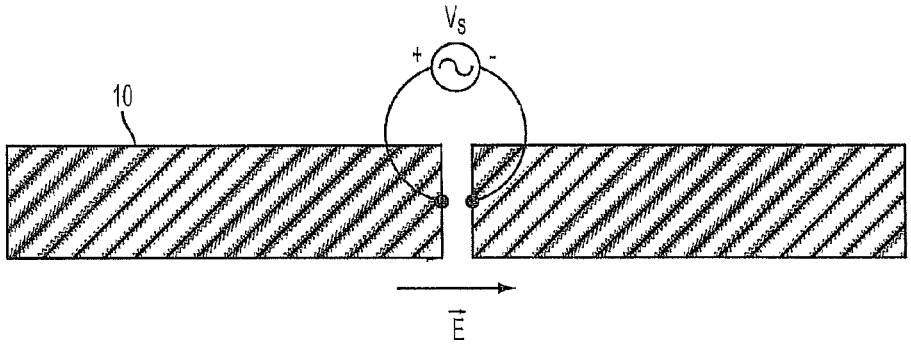
FIG. 1 is a schematic view of a dipole antenna in accordance with the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include a structure that can provide a 120 degree E-plane half power beamwidth. Preferably, such a structure can be easily adjusted for other beamwidths and provide high isolation between polarizations.

In accordance with the present invention, a dual polarized antenna with vertical and horizontal polarizations can maintain orthogonal polarizations over the entire coverage sector, thus providing optimum polarization diversity at all sector angles. Because the elements for vertical polarization are orthogonal to those of the horizontal polarization, and vice versa, high isolation between the elements of the two polarizations can be achieved.

It is known that the E-plane beamwidth of a dipole element is generally not sufficient to produce a horizontally polarized 120 degree half power beamwidth (HPBW) in a sectoral coverage antenna. However, in accordance the present invention, a dipole element can be complimented with a slot element of equal dimensions in a ground plane, for example, an infinite or finite ground plane, to achieve a radiation structure with the desired E-plane half power beamwidth.

Figure 2:
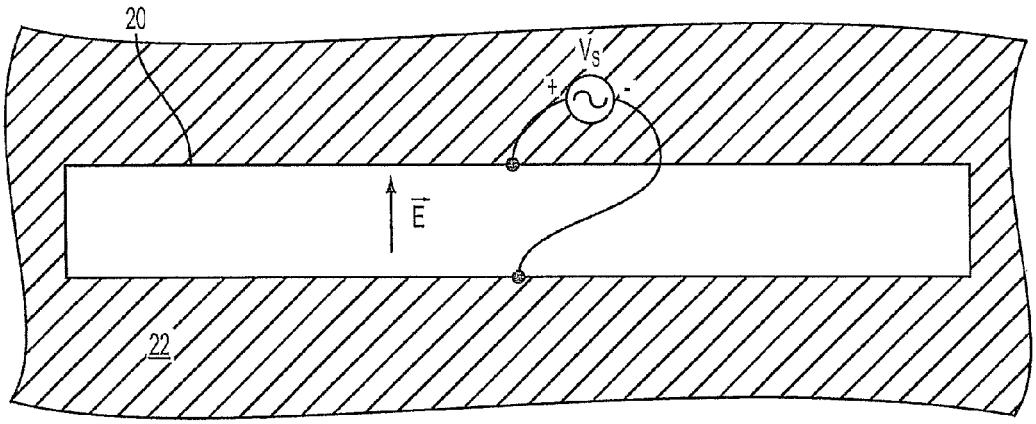
FIG. 2 is a schematic view of a slot antenna in an infinite ground plane that is complementary to the dipole of FIG. 1.

For example, FIG. 1 is a schematic view of a dipole antenna 10 in accordance with the present invention, and FIG. 2 is a schematic view of a slot antenna 20. In some embodiments, the dipole antenna 10 can be a strip dipole antenna.

The slot antenna 20 can be complimentary to the dipole antenna 10 of FIG. 1 and, in some embodiments, the slot antenna 20 can be disposed in an infinite ground plane 22. In embodiments of the present invention, a dominant axis, that is, a longer axis, of the dipole 10 can be generally parallel to the E-plane, and a dominant axis, that is, a longer axis, of the slot 20 can be generally orthogonal to the E-plane.

In accordance with the present invention and applying Babinet's Principle, if the dipole antenna 10 and the slot antenna 20 have equal dimensions, they can produce radiation patterns, for example, far field radiation patterns, that are equal and have orthogonal polarizations. With the use of the slot radiator 20, even in a finite ground plane, a wide E-plane beamwidth can be achieved just as the broad H-plane beamwidth can be achieved with a dipole radiator.

Figure 3:
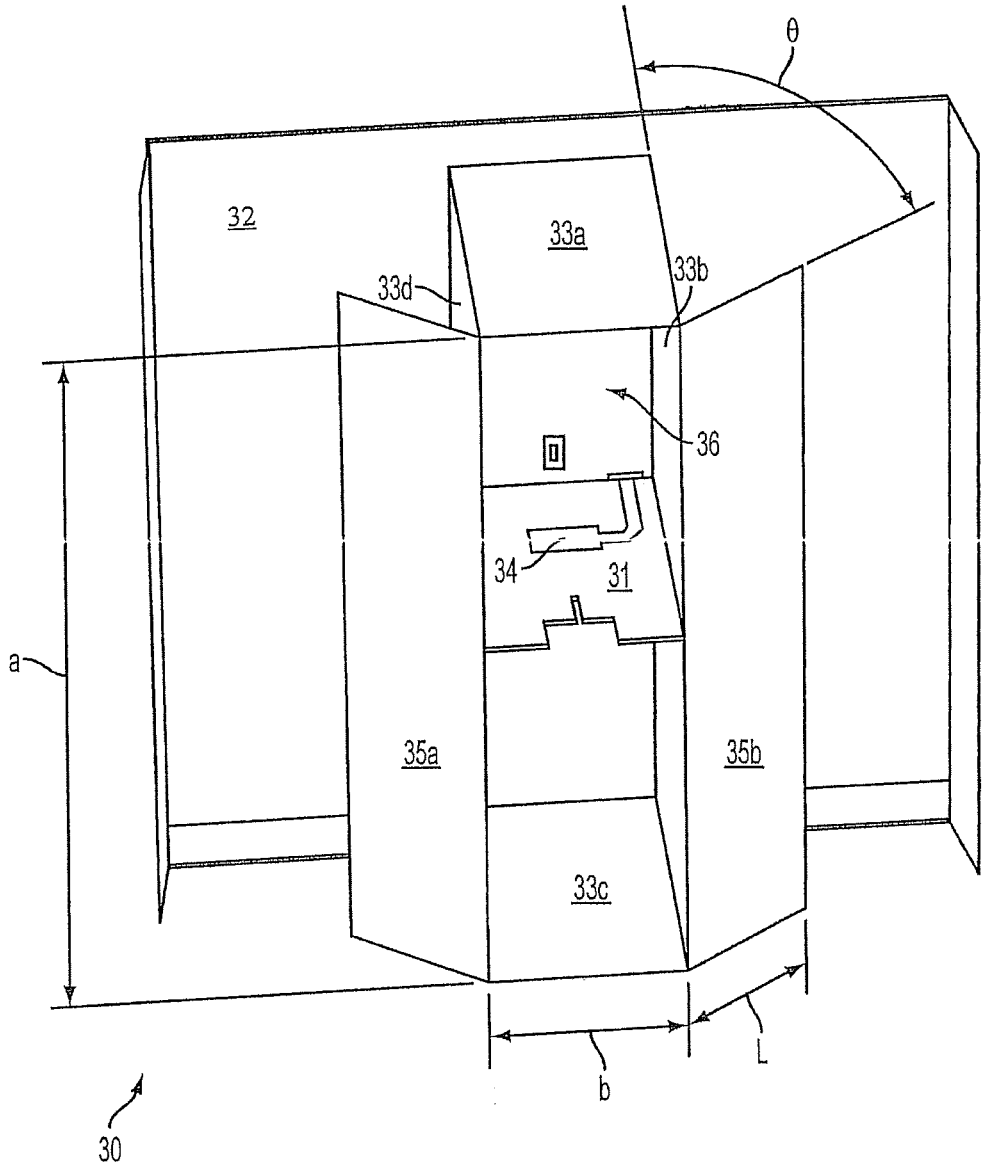
FIG. 3 is a perspective view of an apparatus in accordance with the present invention.
Figure 4:
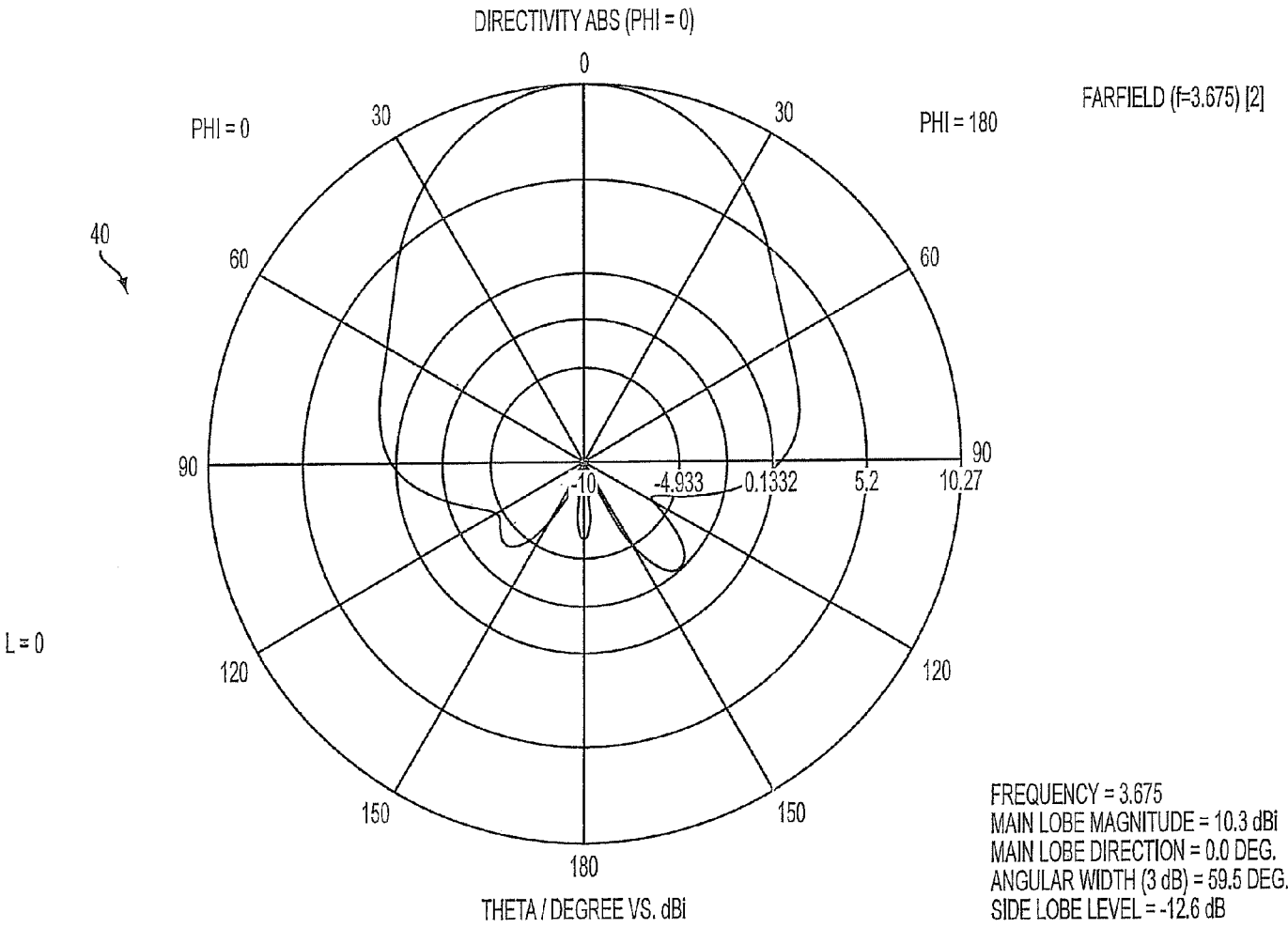
FIG. 4 is a graph of the E-plane half power beamwidth for an angle θ of 35 degrees and a length L of 0 in accordance with the present invention.
Figure 5:
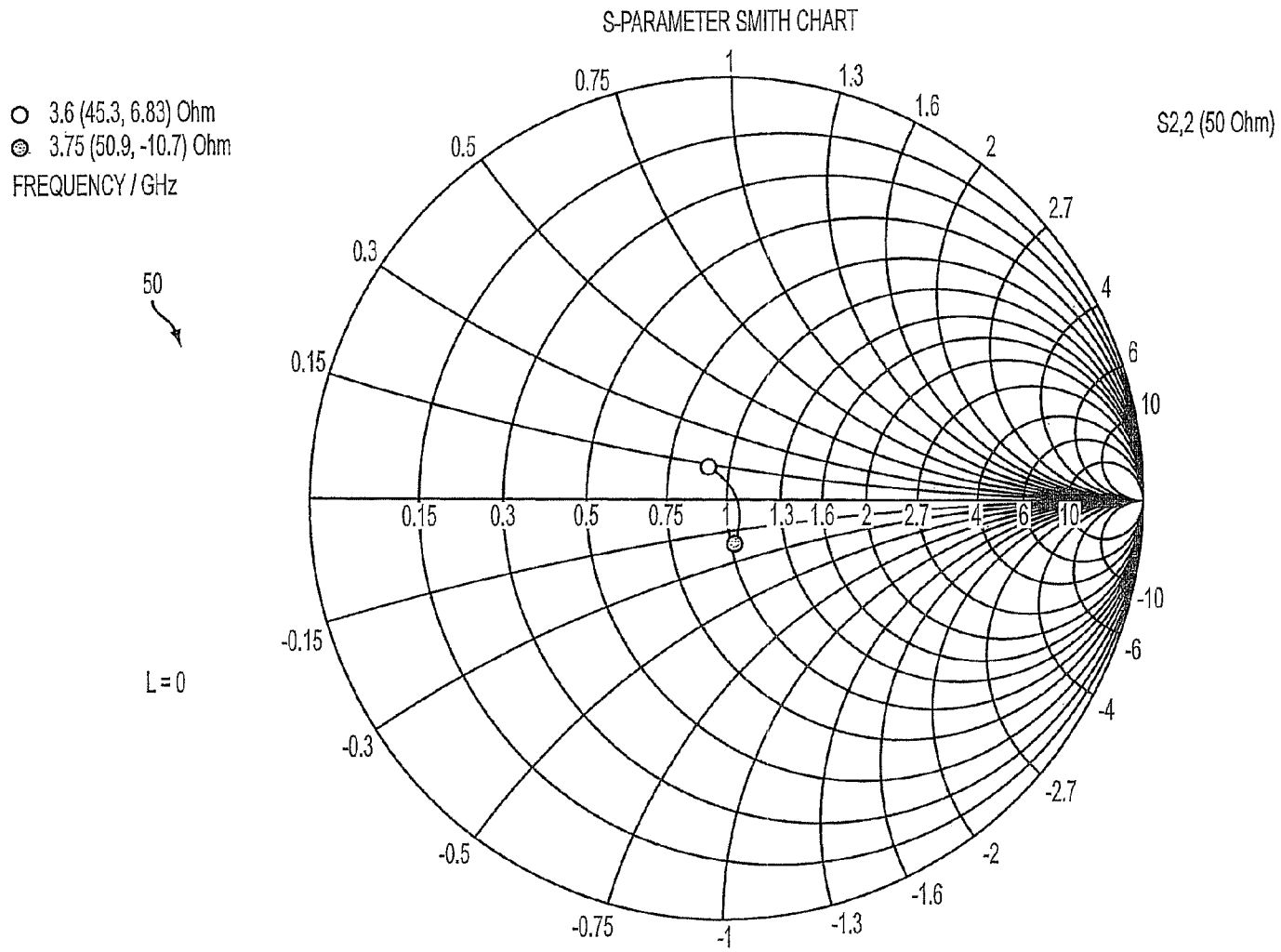
FIG. 5 is a chart showing input impedance when the length L is 0 in accordance with the present invention.
Figure 6:
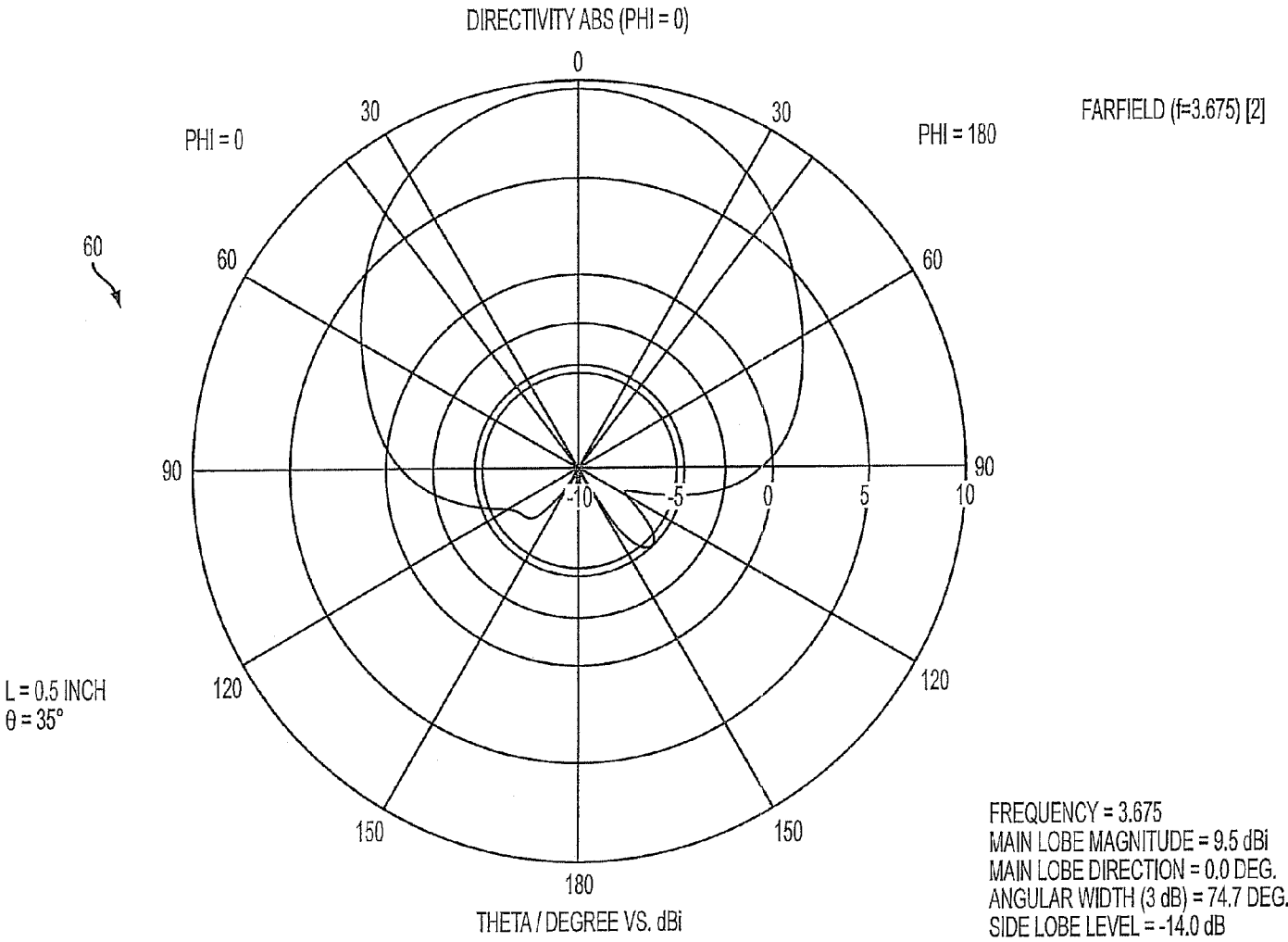
FIG. 6 is a graph of the E-plane half power beamwidth for an angle θ of 35 degrees and a length L of 0.5 inches in accordance with the present invention.
Figure 7:
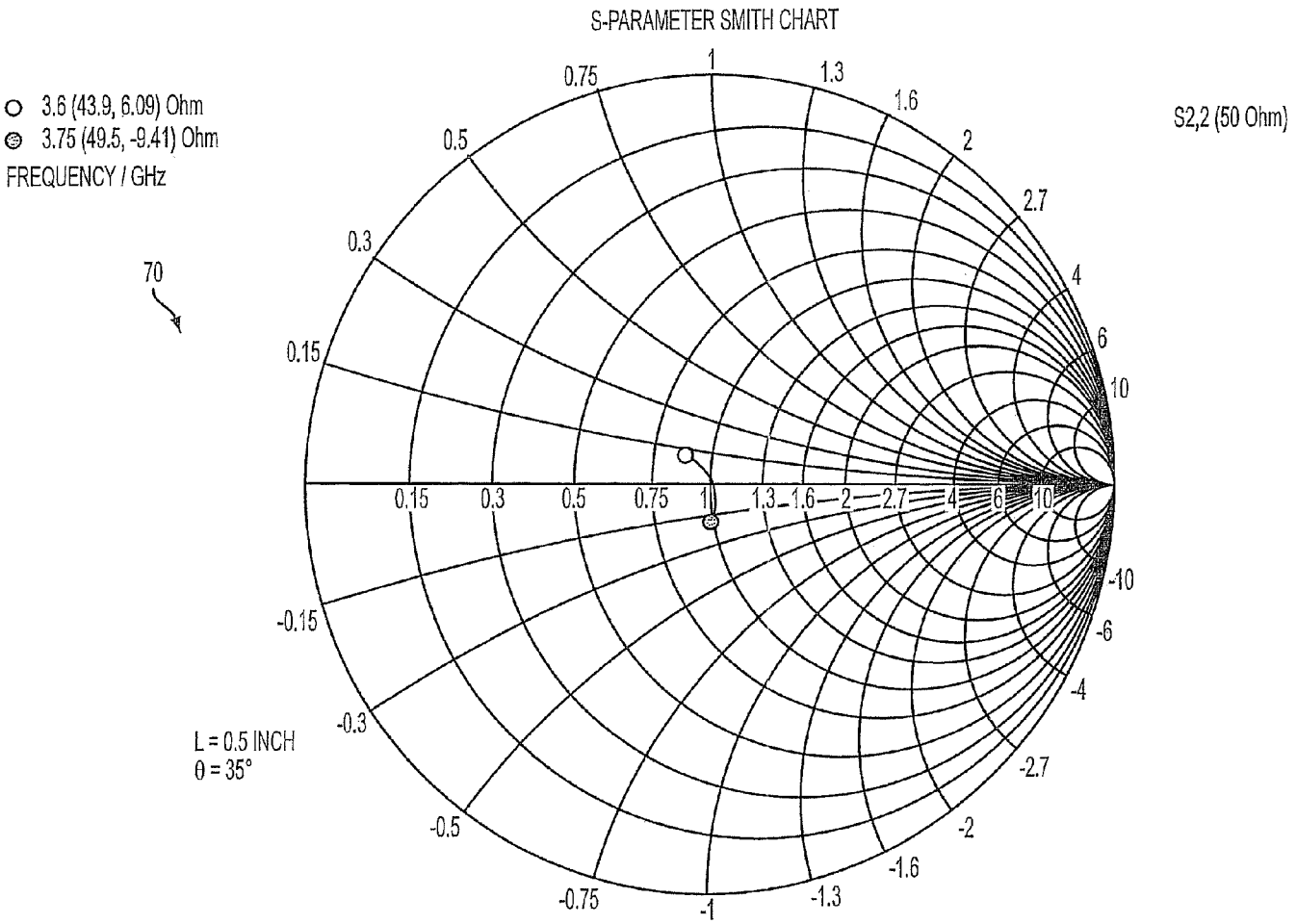
FIG. 7 is a chart showing input impedance when the length L is 0.5 inches in accordance with the present invention.
Figure 8:
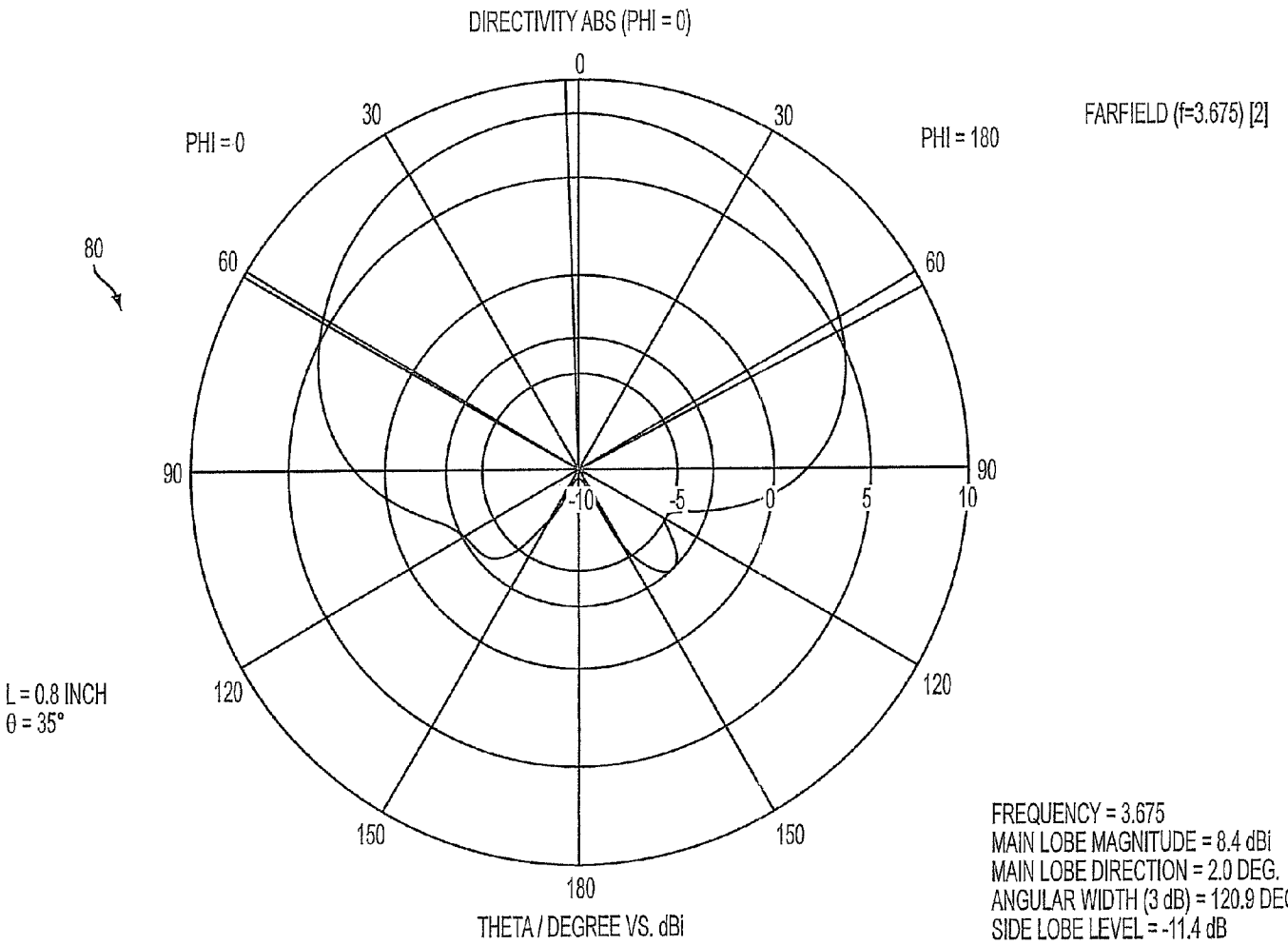
FIG. 8 is a graph of the E-plane half power beamwidth for an angle θ of 35 degrees and a length L of 0.8 inches in accordance with the present invention.
Figure 9:
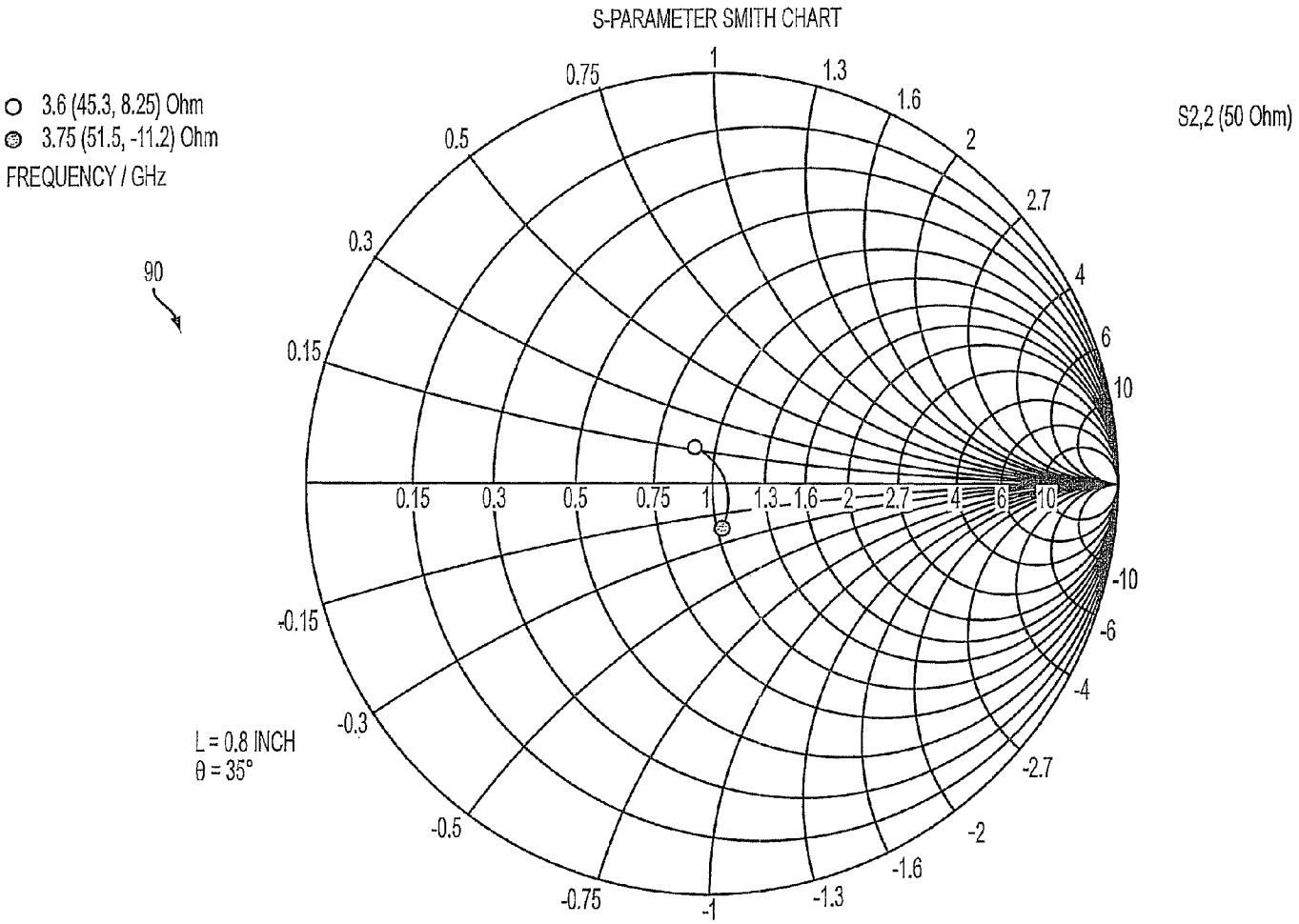
FIG. 9 is a chart showing input impedance when the length L is 0.8 inches in accordance with the present invention.
Figure 10:
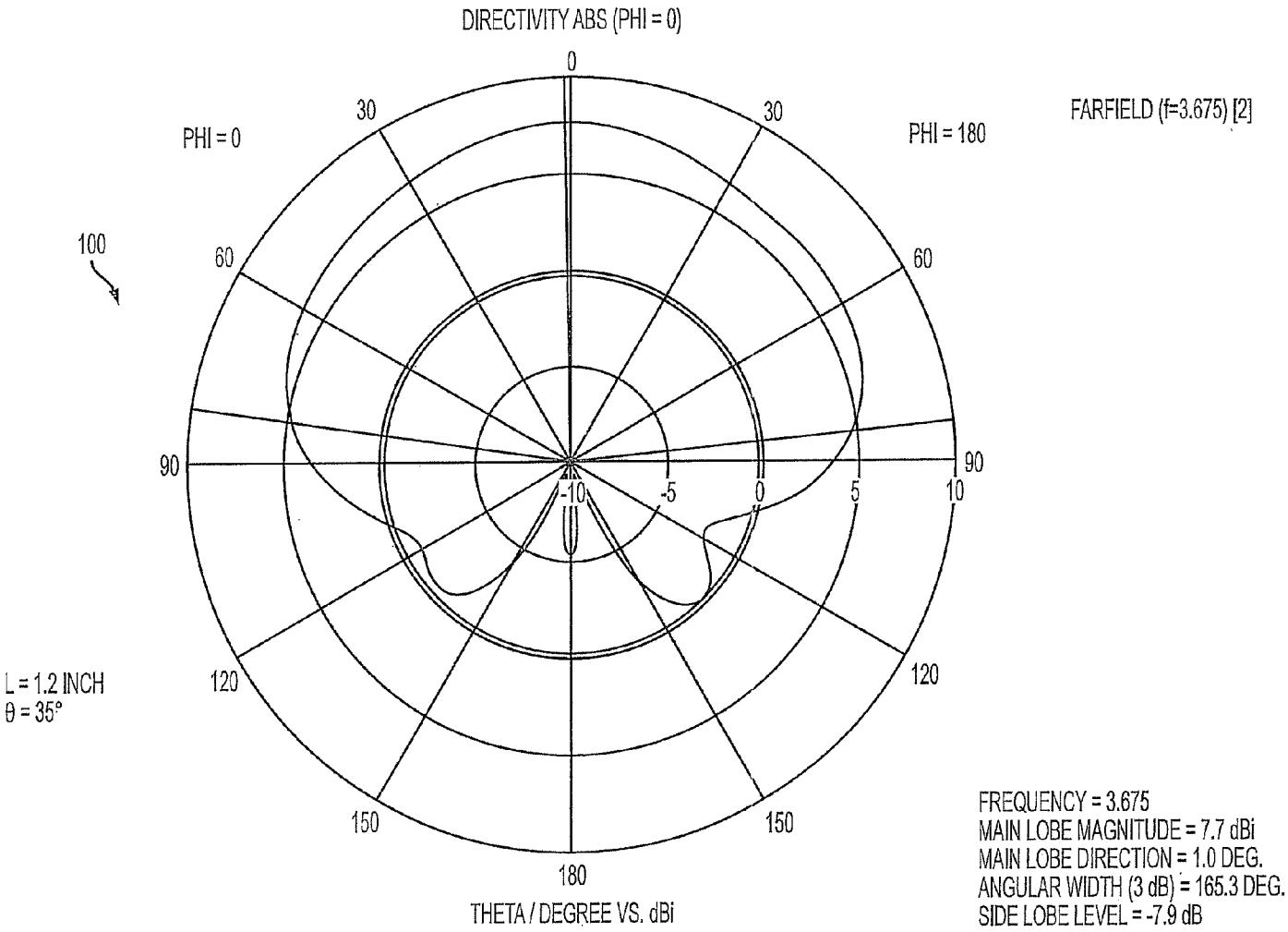
FIG. 10 is a graph of the E-plane half power beamwidth for an angle θ of 35 degrees and a length L of 1.2 inches in accordance with the present invention.
Figure 11:
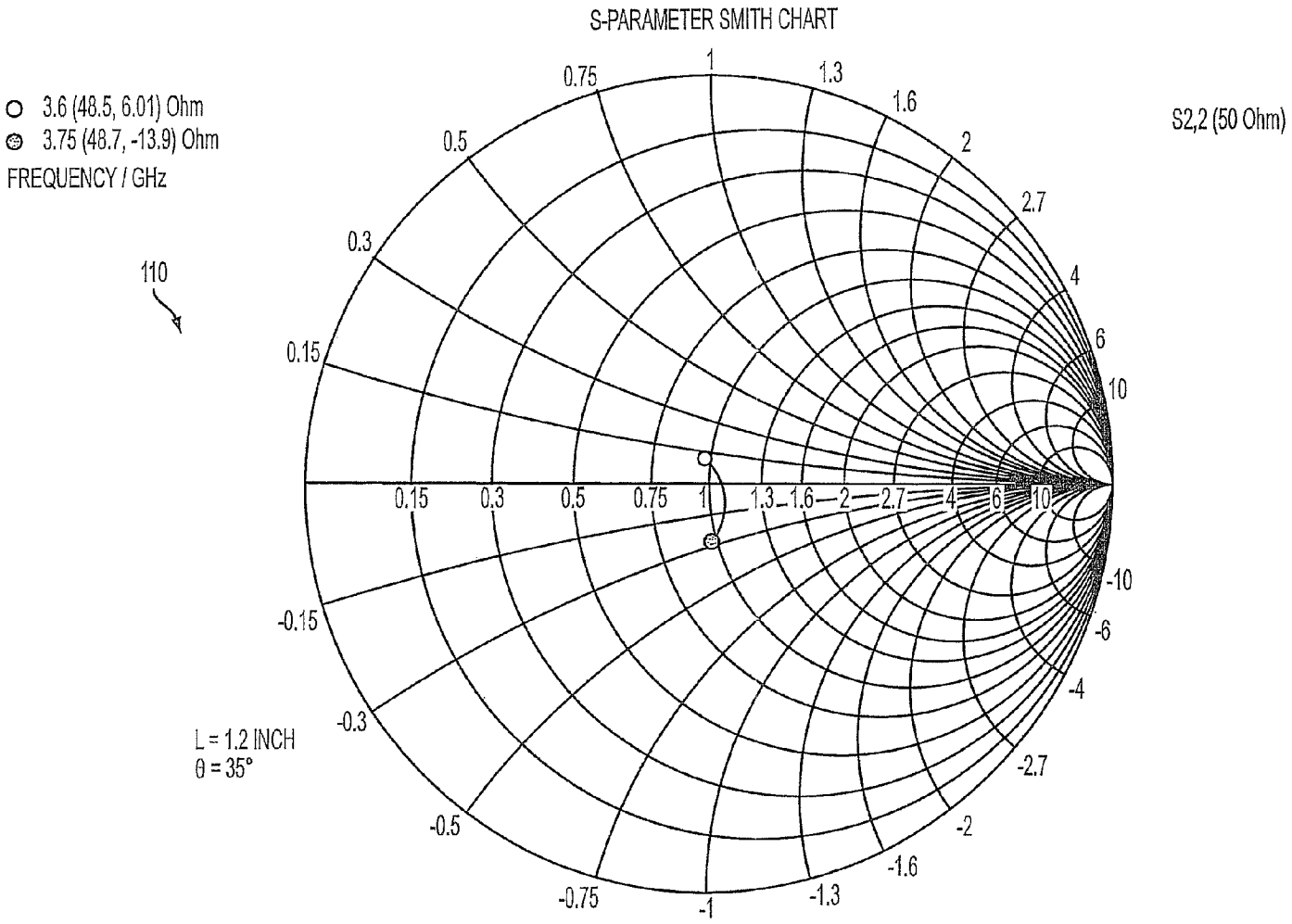
FIG. 11 is a chart showing input impedance when the length L is 1.2 inches in accordance with the present invention.

Similar to the slot antenna 20 in the infinite ground plane 22 shown in FIG. 2, an apparatus in accordance with the present invention can include an open ended waveguide with appropriate surrounding structure to produce a 120 degree E-plane half power beamwidth. FIG. 3 is a perspective view of such an apparatus 30.

As seen in FIG. 3, a waveguide 36, can be defined by a plurality of waveguide walls 33*a*, 33*b*, 33*c*, 33*d*. In some embodiments, the waveguide 36 can be rectangular. The waveguide 36 can include a printed circuit board 31 disposed therein and can be shorted with a back plane 32. One side of each of the waveguide walls 33*a*, 33*b*, 33*c*, 33*d* can be affixed to the back plane 32 to define an internal dimension α of the waveguide 36, and in some embodiments, some or all of the back plane 32 and the waveguide walls 33*a*, 33*b*, 33*c*, 33*d* can be metal.

In some embodiments, the first and third waveguide walls 33*a*, 33*c* can be considered the narrow walls of the waveguide and have a length b as shown in FIG. 3. The second and fourth waveguide walls 33*b*, 33*d* can be considered the broad walls of the waveguide and have a length a as shown in FIG. 3. The area a×b can be equal to a cross-section of the internal dimension α of the waveguide.

An E-plane probe 34 can be affixed to the printed circuit board 31 or otherwise mechanically supported within the waveguide 36 so as to excite the fundamental $TE_{10}$ mode of the waveguide 36. The internal dimension α can allow for propagation of the $TE_{10}$ mode.

First and second adjustable plates 35*a*, 35*b*, for example metal plates, can be adjustably attached along respective second and fourth waveguide walls 33*b*, 33*d*, that is, the broad walls of the waveguide 36, so as to be disposed at an open end of the waveguide 36. A length L can include a length along the subordinate, that is, shorter axis, of each plate 35*a*, 35*b*. An angle θ can include an angle between either of the first or second adjustable plates 35*a*, 35*b* and the first or third waveguide walls 33*a*, 33*c*, that is, the narrow waveguide walls.

In accordance with the present invention, the length L and angle θ as seen in FIG. 3 can be adjusted to produce a desired E-plane half power beamwidth and impedance. For example, for an angle θ of about 35 degrees, the E-plane half power beamwidth can be adjusted from about 60 degrees for L=0 to about 165 degrees for L=1.3 inches. FIGS. 4, 6, 8, and 10 are graphs 40, 60, 80, and 100, respectively of the E-plane half power beamwidth at an angle θ of 35 degrees when L=0, 0.5, 0.8, and 1.2 inches, respectively.

FIGS. 5, 7, 9, and 11 are charts 50, 70, 90, and 110, respectively, showing input impedance when L=0, 0.5, 0.8, and 1.2 inches, respectively. As can be seen, changes to the length L can result in only small changes of the input impedance. Thus, in accordance with the present invention, the length L can be dynamically adjusted to vary the E-plane beamwidth without significant impedance changes. In embodiments of the present invention, the length L can be dynamically adjusted through an electrical and/or mechanical process.

Figure 12:
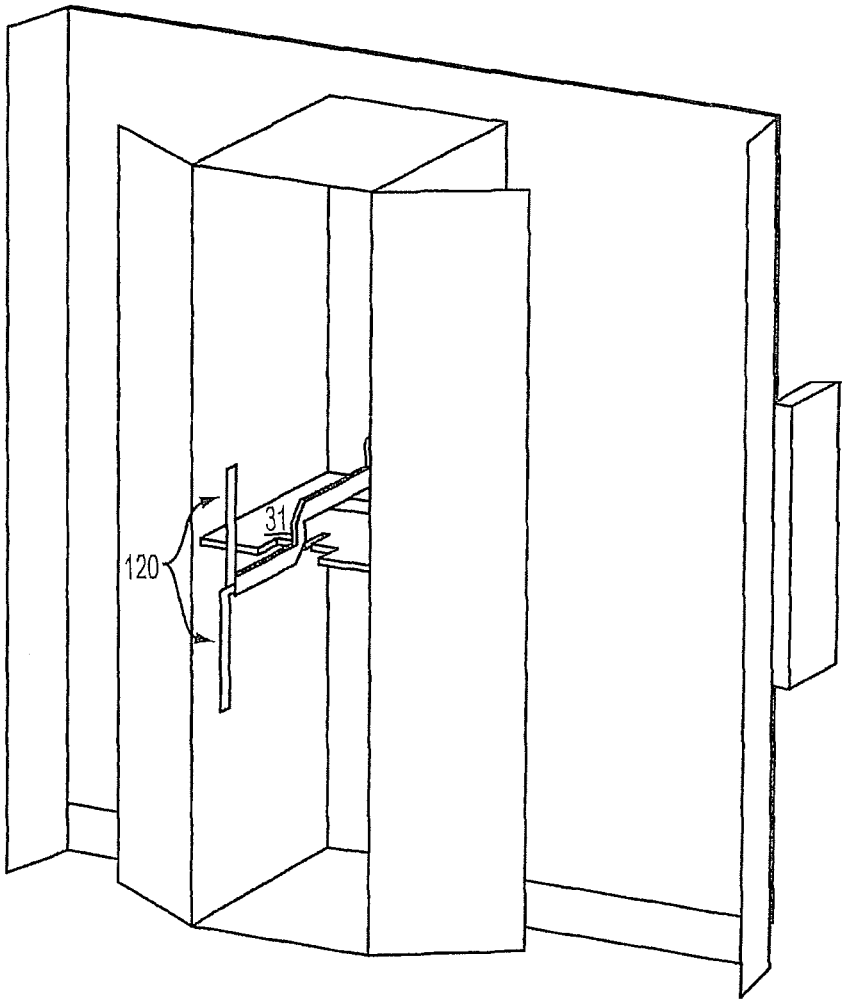
FIG. 12 is a perspective view of a dipole placed over or substantially near the center of a waveguide in accordance with the present invention.
Figure 13:
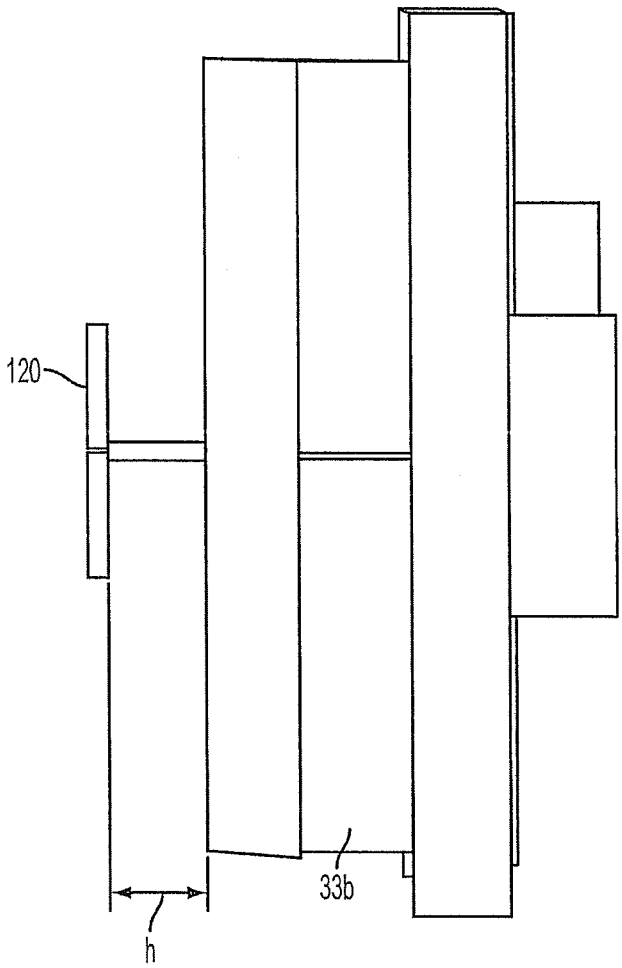
FIG. 13 is a side view of the dipole placed over or substantially near the center of the waveguide in accordance with the present invention.

With a waveguide in accordance, with the present invention, a dipole can be placed over or substantially near an approximate center of the waveguide to achieve operation with dual polarizations. For example, FIGS. 12 and 13 are perspective and side views, respectively, of a dipole 120 placed over or substantially near the approximate center of the waveguide 36. In FIG. 12, the dielectric supporting structure is not shown for clarity.

As best seen in FIG. 13, the H-plane beamwidth for the dipole 120 can be varied by adjustment of the dimension h. The dimension h can include a distance from the distal end of the first or second vertical waveguide walls 33*b*, 33*d* (the broad walls) to the conductors of the dipole 120.

In some embodiments of the present invention, the dipole 120 can be fed with a balanced feed line (balanced microstrip) from a printed circuit board 140 on a second side of the back plane 32. It is to be understood that the dipole 120, the waveguide 36, and the surrounding structure of the waveguide 36 can be disposed on a first side of the back plane 32.

Figure 14:
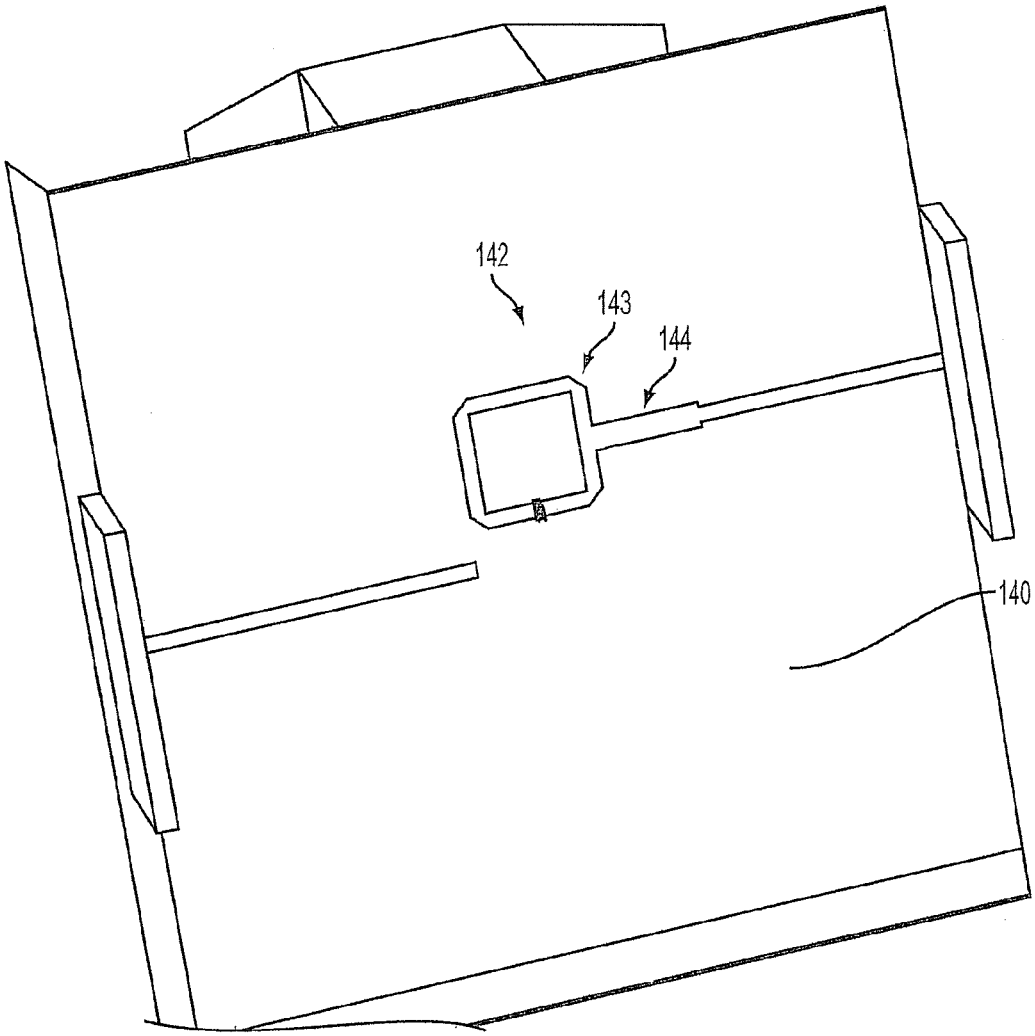
FIG. 14 is an exemplary view of a printed circuit board and balun structure in accordance with the present invention.

FIG. 14 is an exemplary view of a printed circuit board 140 and a balun structure 142 in accordance with the present invention. As seen in FIG. 14, the balun structure 142 can include a balun 143 and an impedance transformer 144. The balun 143 and the impedance transformer 144 can each be deposited on the printed circuit board 140, which, in some embodiments, can be a feed distribution board.

The balun structure 142 can form a junction that acts as a power divider with two path lengths of microstrip, l1 and l2. For example, FIG. 15 is an enlarged view of the balun structure 142 in accordance with the present invention.

Figure 15:
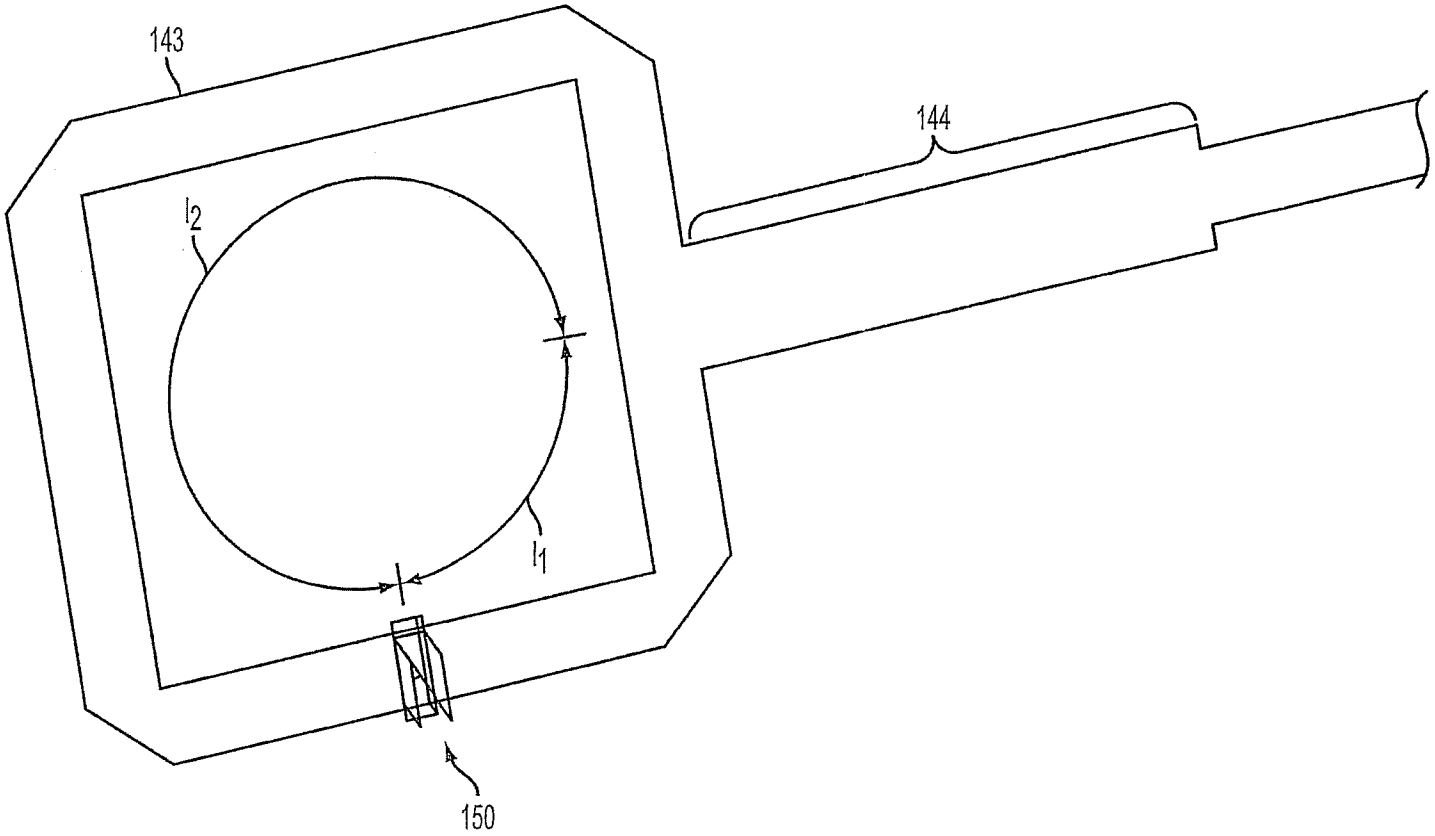
FIG. 15 is an enlarged view of the balun structure in accordance with the present invention.

As seen in FIG. 15, the balun structure 142 can include a connection point 150 from the balanced feed line to the dipole 120 on the first side of the back plane 32. In embodiments of the present invention, lengths l1 and l2 can have a 180 degree difference in electrical length from one another to provide proper differential feed to the balanced transmission line.

It is to be understood that waveguides and radiators as explained and described above can be placed in an array to produce other radiation patterns in accordance with the present invention. For example, radiation patterns with higher directivity can be achieved by placing waveguides and dipole radiators in an array.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. An apparatus comprising:

a single polarized dipole antenna; and a slot antenna complimentary to the dipole antenna, wherein the slot antenna is disposed in or elevated above a ground plane that is external to a waveguide structure of the apparatus, and wherein a polarization of the dipole antenna is orthogonal to a polarization of the slot antenna.

2. The apparatus of claim 1 wherein a dominant axis of the dipole antenna is parallel to an E-plane of radiation emitted from the dipole antenna.

3. The apparatus of claim 1 wherein a dominant axis of the slot antenna is orthogonal to an E-plane of radiation emitted from the slot antenna.

4. The apparatus of claim 1 wherein the dipole antenna emits a first radiation pattern, wherein the slot antenna emits a second radiation pattern, and wherein the first and second radiation patterns are substantially equal.

5. The apparatus of claim 1 wherein the polarization of the dipole antenna is orthogonal to the polarization of the slot antenna over an entire coverage sector.

6. The apparatus of claim 1 wherein radiation emitted from the slot antenna includes a desired E-plane half power beamwidth.

7. The apparatus of claim 1 wherein radiation emitted from the dipole antenna includes a desired H-plane half power beamwidth.

8. The apparatus of claim 1 wherein a dominant axis of the dipole antenna is orthogonal to an E-plane of radiation emitted by slot antenna.

9. The apparatus of claim 1 wherein the dipole antenna includes a strip dipole antenna.

10. The apparatus of claim 1 wherein the dipole antenna and the slot antenna are driven separately.

11. The apparatus of claim 1 wherein the dipole antenna includes first and second conductors, wherein the first conductor is polarized in a first direction, and wherein the second conductor is polarized in the first direction.

12. The apparatus of claim 1 wherein the dipole antenna includes first and second conductors, wherein a dominant axis of the first conductor is parallel with a first axis, and wherein a dominant axis of the second conductor is parallel with the first axis.

13. The apparatus of claim 1 wherein the ground plane is a reflecting surface for radiation emitted externally from the apparatus.

14. The apparatus of claim 1 wherein the ground plane provides an image of radiation emitted externally from the apparatus.

15. An apparatus comprising:

a single polarized dipole antenna, the dipole element having a first single polarization; and a slot antenna complimentary to the dipole antenna, the slot antenna having a second single polarization, wherein the slot antenna is disposed in or elevated above a ground plane that is external to a waveguide structure of the apparatus, and wherein the first single polarization of the dipole antenna is orthogonal to the second single polarization of the slot antenna.

16. An apparatus comprising:

a single polarized dipole antenna, the dipole element having a first single dominant axis; and a slot antenna complimentary to the dipole antenna, the slot antenna having a second single dominant axis, wherein the slot antenna is disposed in or elevated above a ground plane that is external to a waveguide structure of the apparatus, and wherein a polarization of the dipole antenna is orthogonal to a polarization of the slot antenna.

17. The apparatus of claim 16 wherein the first single dominant axis of the dipole antenna is physically parallel to the second single dominant axis of the slot antenna.

* * * * *